US006984788B2

(12) United States Patent
Grögl et al.

(10) Patent No.: US 6,984,788 B2
(45) Date of Patent: Jan. 10, 2006

(54) DATA TRANSMISSION CABLE FOR CONNECTION TO MOBILE DEVICES

(75) Inventors: Ferdinand Grögl, Nuremberg (DE); Thomas Mann, Weissenohe (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/766,840

(22) Filed: Jan. 30, 2004

(65) Prior Publication Data

US 2004/0245009 A1 Dec. 9, 2004

(30) Foreign Application Priority Data

Jan. 31, 2003 (DE) ..... 103 03 809

(51) Int. Cl.
*H01B 7/18* (2006.01)

(52) U.S. Cl. ..... 174/106 R

(58) Field of Classification Search ..... 174/116, 174/113 R, 113 C, 106 R, 36, 131 A, 108, 174/109, 27
See application file for complete search history.

(56) References Cited

U.S. PATENT DOCUMENTS 2,186,793 A * 1/1940 Wodtke ..... 174/27
3,433,890 A * 3/1969 Gabriel et al. ..... 174/116
3,678,177 A * 7/1972 Lawrenson ..... 174/113 C
3,843,831 A 10/1974 Hutchinson et al.
5,132,491 A * 7/1992 Mulrooney et al. ..... 174/36
5,313,020 A * 5/1994 Sackett ..... 174/113 C
6,310,286 B1 * 10/2001 Troxel et al. ..... 174/36
6,583,361 B2 * 6/2003 Clouet et al. ..... 174/108

FOREIGN PATENT DOCUMENTS

DE 652587 11/1937
DE 2 309 806 8/1974
DE 188 96 935 A1 8/2000

* cited by examiner

*Primary Examiner*—Chau N. Nguyen
(74) *Attorney, Agent, or Firm*—Sughrue Mion, PLLC

(57) ABSTRACT

A data transmission cable for connection to mobile devices, which has at least two insulated conductors (1, 2) twisted together into a pair. The pair is enclosed by an electric shield (7) over which a jacket (13) made of an insulating material is applied. To preserve the function of the cable even if it is subject to frequently alternating bending and torsional stresses, the two conductors (1, 2) insulated with a solid unfoamed material are twisted together with two first strands (4, 5) made of a foamed insulating material to form a core (S). The core (S) is enclosed by a foil (6) made of a foamed insulating material, and the shield (7) formed around the first foil (6) has at least one metal strip that is made of an electrically well-conducting material and is formed into a closed tubular sleeve.

17 Claims, 1 Drawing Sheet

DATA TRANSMISSION CABLE FOR CONNECTION TO MOBILE DEVICES

BACKGROUND OF THE INVENTION

A data transmission cable for connection to mobile devices includes at least two insulated conductors twisted into a pair, in which the pair is enclosed by an electric shield over which a jacket of insulating material is applied.

Such data transmission cables—hereinafter referred to as "cables" for short—are intended for use as flexible cables for connecting mobile devices with a voltage or signal source. Such devices can be, for example, cranes, machine tools and robots. The cables must withstand high mechanical loads and their bending and torsional strength must remain constant over an indefinite period of time. They must also remain flexible over a wide range of temperatures, for example −40° to +80° C. The elements of these cables must further be constructed in such a way that the transmission of data at increased data rates is not affected. This applies, in particular, to data rates greater than 100 Mbit/sec. In addition to the lowest possible attenuation of the data to be transmitted, adequate electric shielding is also required so that external fields do not influence the data transmission and so that a cable of this type does not emit interfering radiation.

In conventional, commercially available cables, the conductors are insulated with a foamed material so as to obtain the lowest possible dielectric constant. Although this is useful electrically, it has a negative effect on the mechanical and thus also the electrical properties of such a cable. The foamed insulation materials with wall thicknesses ranging around 0.2 mm are relatively soft and can easily be compressed if subjected to frequently alternating bending and torsional stresses. The cables are further shielded by a copper wire braid, which as a rule has sufficient electric density at higher frequencies or data rates to prevent passive or active interference with the cables. Such a shield is not suitable, however, for cables in robotic applications. It is easily destroyed by the frequently alternating bending and torsional stresses.

SUMMARY OF THE INVENTION

The object of the invention is to design the initially described cable in such a way as to ensure low attenuation and interference-free data transmission with effective shielding at data rates of up to and exceeding 100 Mbit/sec even with frequently alternating bending and torsional stresses.

This object is attained according to the invention by twisting the two conductors insulated with a solid unfoamed material together with two first strands made of a foamed insulating material to form a core, enclosing the core by a first foil made of foamed insulating material, and the shield formed around the first foil having at least one metal strip that is made of an electrically well-conducting material and is formed into a closed tubular sleeve.

In this cable, the conductors are insulated with a solid, unfoamed material. The insulation of the strands thus formed is therefore stable and cannot be compressed even if subject to constantly alternating bending and torsional stresses. A sufficiently low dielectric constant is obtained for each pair by the strands of foamed insulation material which are twisted together with the conductors and which also contribute to the increased stability and roundness of a pair and, further, by the first foil enclosing each pair, which is likewise made of a foamed insulating material. The shield, which is a closed metallic sleeve, ensures dense shielding even for the highest frequencies or data rates. The shield can be completed by stranded tin-plated copper wires, which support and thus stabilize the subjacent metal strip from the outside.

In a preferred embodiment, the closed tubular sleeve of the shield consists of two metal strips that are wound staggered on top of each other, with the outer metal strip covering the gaps of the inner metal strip. These two metal strips, which are wound so as to form gaps, result in an almost closed but nevertheless readily flexible, torsionally strong metal tube. Tin-plated copper wires can again be stranded over the outer metal strip.

BRIEF DESCRIPTION OF THE DRAWINGS

Exemplary embodiments of the subject of the invention are depicted in the drawings, in which.

DETAILED DESCRIPTION OF THE INVENTION

Figure 1:
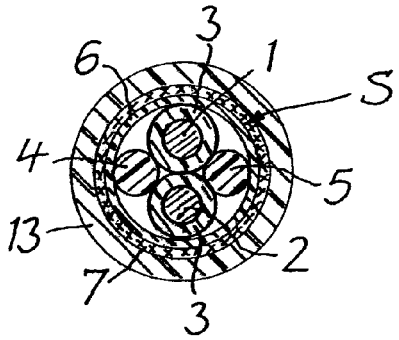
FIG. 1 is a cross section of a cable according to the invention with a pair of insulated conductors.

The cable shown in FIG. 1 has two insulated copper conductors 1 and 2—hereinafter referred to as "conductors 1 and 2"—each of which is enclosed by a solid unfoamed insulation material 3. The conductors 1 and 2 are twisted together to form a pair. Two first strands 4 and 5 made of a foamed insulating material are twisted together with the conductors 1 and 2. The conductors 1 and 2 together with the strands 4 and 5 form a core S of the cable. The first strands 4 and 5 stabilize the core S overall giving it a high air content. They fill the spaces between the two conductors 1 and 2 in such a way that a first foil 6 made of a foamed insulating material and enclosing the core S has an approximately circular base.

In a preferred embodiment, the wires of the conductors 1 and 2 are litz wires. For the insulation 3 of the conductors 1 and 2, high density polyethylene or polypropylene is advantageously used. The insulation 3 can also consist of two firmly interconnected layers, namely a softer inner layer contacting the conductors and a harder outer layer surrounding the inner layer. The conductors 1 and 2 have, for example, a maximum outside diameter of 1.0 mm if they are to be used in conventional connector systems, e.g., RJ-45. The first strands 4 and 5 are preferably made of foamed polyethylene or polypropylene. For the first foil 6, foamed polytetrafluoroethylene is used in a preferred embodiment. This material ensures good electrical values. It also has good antifriction properties.

The core S, which consists of the conductors 1 and 2 and the first strands 4 and 5 and which is enclosed by the first foil 6, is mechanically stable. It can withstand frequently alternating bending and torsional stresses without damage. The core S nevertheless has good electrical properties since it includes a lot of air due to the first strands 4 and 5 and the first foil 6, which is made of a foamed material.

Figure 2:
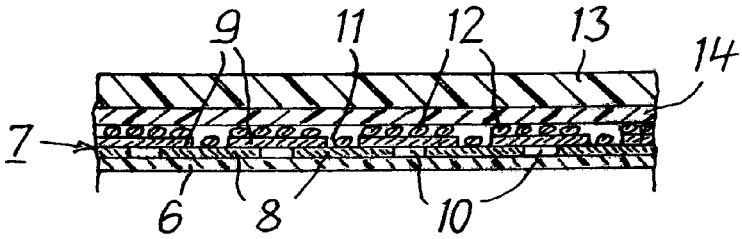
FIGS. 2 and 3 show embodiments of the shield of the cable in magnified form.

A shield 7, including at least one metal strip made of copper or tin-plated copper and formed into a closed tubular sleeve, is applied over the first foil 6. As shown in FIG. 2, the shield 7 consists of two layers in which metal strips 8 and 9 are wound over the first foil 6 with gaps 10 and 11. The outer metal strip 9 covers the gaps 10 between the turns of the inner metal strip 8. To further stabilize the shield 7, tin-plated copper wires 12 can be stranded over the outer metal strip 9 with ≧90% coverage. A jacket 13 made of an insulating material is disposed over the shield 7. It is made of, e.g., polyurethane. To make it easier to strip the jacket a separator layer 14 consisting of a fiber band made of a nonwoven polyester material or cellulose paper can be wound between the jacket 13 and the shield 7.

The metal strips 8 and 9 in the embodiment of the shield 7 according to FIG. 2 preferably consist of a braid. To produce them, copper wires, which can also be tin-plated, are used to braid tubular hollow strands that are subsequently pressed into metal strips. These metal strips are compact but are nevertheless highly flexible.

The gaps 10 and 11 between the turns of the metal strips 8 and 9 should not be larger than 30% of the width of the two metal strips 8 and 9. This produces reliable coverage of the gap 10 by the outer metal strip 9, such that an overlap between the two metal strips 8 and 9 is preserved even if the cable is bent to an extreme degree.

Figure 3:
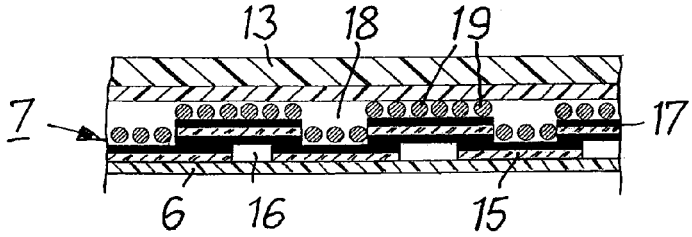

Another embodiment of the shield 7 is shown in FIG. 3. Here, the shield 7 is constructed from 3 layers. It has an inner metal strip 15 which consists of an insulating layer and a metal layer firmly connected therewith and which contacts the first foil 6. The metal strip 15 is wound around the first foil 6, with its metal layer facing outward, so as to form a gap 16. The second metal strip 17 of the shield 7 has two metal layers that are firmly interconnected with an insulation layer placed therebetween. The metal strip 17 is wound around the metal strip 15 forming a gap 18 in such a way that it covers the gap 16 of the metal strip 15 as described in the embodiment of shield 7 according to FIG. 2. A stranding of tin-plated copper wires 19 is placed over the metal strip 17 with ≧90% coverage. The jacket 13 made of insulating material and the optional separator layer 14 are placed over the copper wires 19.

Figure 4:
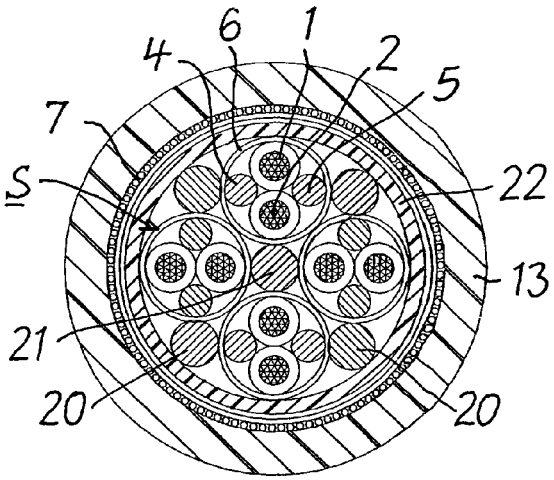
FIG. 4 is a cross section of a cable with four pairs.

The cable can also have two or more cores S. According to FIG. 4 it has, for example, four cores S, each of which is constructed and provided with a first foil 6 in the manner described with reference to FIG. 1. The four cores S are twisted together with four strands 20 made of a foamed insulating material so as to form a unit having an approximately circular cross section. A further strand 21 of foamed insulating material can be placed in the center between the cores S. The described unit is enclosed by a second foil 22 made of a foamed insulating material. Placed on top thereof—as shown in FIG. 2—is the shield 7, the separator layer 14 and the jacket 13.

The strands 20 and 21 can again be made of foamed polyethylene or polypropylene. The second foil 22 can again be made of foamed polytetrafluoroethylene.

To obtain the desired alternating bending strength and twistability of the cable with increased reliability, it is useful to strand or wind all the stranding elements—i.e., the conductors 1 and 2 as well as the strands 4 and 5—, the metal strips of the shield 7 and optionally the tin-plated copper wires 12 and 19 in the same direction. This also applies to the individual wires of the conductors if they are litz wires. In a preferred embodiment, all the cited structural elements of the cable are strand or wound at the same angle.

What is claimed is:

1. A data transmission cable for connection to mobile devices, comprising at least two insulated conductors twisted into a pair, in which the pair is enclosed by an electric shield which is surrounded by a jacket made of an insulating material, wherein the two conductors which are insulated by a solid unfoamed material are twisted together with two strands made of a foamed insulating material to form a core, the core is enclosed by a first foil made of a foamed insulating material to form an insulated core, and the shield comprises three layers, with an inner metal strip that has a metal layer and an insulating layer, an outer metal strip that is made of two metal layers and an insulating layer disposed therebetween, and a stranding made of tin-plated copper wires arranged over the outer metal strip with ≧90% coverage, and the inner metal strip with the metal layer facing outward is wound around a core structure with a gap while the outer metal strip is wound around the inner metal strip also with a gap staggered with respect to, and thereby covering, the gap of die inner metal strip, said core structure comprising at least one said insulated core.

2. A data transmission cable as claimed in claim 1, wherein said core structure comprises at least two said insulated cores twisted together with at least two second strands made of a foamed insulating material to form a unit which is enclosed by a second foil made of a foamed insulating material, and said shield is placed over the second foil.

3. A cable as claimed in claim 1, wherein the metal layers of the metal strips used for the shield are made of copper.

4. A cable as claimed in claim 1, wherein the insulating material of the metal strips of the shield is made of polyester.

5. A cable as claimed in claim 1, wherein the strands of a foamed insulating material are made of polyethylene or polypropylene.

6. A cable as claimed in claim 1, wherein the foils are made of polytetrafluoroethylene.

7. A cable as claimed in claim 1, wherein the inner and outer metal strips of the shield are stranded or wound in the same direction.

8. A cable as claimed in claim 7, wherein the inner and outer metal strips of the shield are stranded or wound at the same angle.

9. The use of a cable as claimed claim 1 for transmission rates of at least 100 Mbit/sec.

10. A data transmission cable for connection to mobile devices, comprising at least two insulated conductors twisted into a pair, in which the pair is enclosed by an electric shield which is surrounded by a jacket made of an insulating material, wherein the two conductors which are insulated by a solid unfoamed material are twisted together with two strands made of a foamed insulating material to form a core, the core is enclosed by a first foil made of a foamed insulating material to form an insulated core, the shield comprises inner and outer metal strips, which are made as tubular hollow strands braided from wires and are subsequently pressed into metal strips, and the inner metal strip is wound around a core structure with a gap, while the outer metal strip is wound around the inner metal strip also with a gap staggered with respect to, and thereby covering, the gap of the inner metal strip, said core structure comprising at least one said insulated core.

11. A cable as claimed in claim 10, wherein a stranding of tin-plated copper wires is placed over the outer metal strip with ≧90% coverage.

12. A cable as claimed in claim 10, wherein said core structure comprises at least two said insulated cores twisted together with at least two second strands made of a foamed insulating material to form a unit which is enclosed by a second foil made of a foamed insulating material, and the shield is placed over the second foil.

13. A cable as claimed in claim 10, wherein the strands of a foamed insulating material are made of polyethylene or polypropylene.

14. A cable as claimed in claim 10, wherein the foils are made of polytetrafluoroethylene.

15. A cable as claimed in claim 10, wherein the inner and outer metal strips of the shield are stranded or wound in the same direction.

16. A cable as claimed in claim 15, wherein the inner and outer metal strips of the shield are stranded or wound at the same angle.

17. The use of a cable as claimed claim 10 for transmission rates of at least 100 Mbit/sec.

* * * * *